US009840923B2

(12) United States Patent
Batt et al.

(10) Patent No.: US 9,840,923 B2
(45) Date of Patent: Dec. 12, 2017

(54) TURBINE VANE ARRANGEMENT

(71) Applicant: Siemens Aktiengesellschaft, Munich (DE)

(72) Inventors: Stephen Batt, Lincoln (GB); Richard Bluck, Welton (GB); David Butler, Nottingham (GB)

(73) Assignee: Siemens Aktiengesellschaft, Munich (DE)

( * ) Notice: Subject to any disclaimer, the term of this patent is extended or adjusted under 35 U.S.C. 154(b) by 417 days.

(21) Appl. No.: 14/425,012

(22) PCT Filed: Aug. 22, 2013

(86) PCT No.: PCT/EP2013/067440
§ 371 (c)(1),
(2) Date: Feb. 28, 2015

(87) PCT Pub. No.: WO2014/037226
PCT Pub. Date: Mar. 13, 2014

(65) Prior Publication Data

US 2015/0226073 A1 Aug. 13, 2015

(30) Foreign Application Priority Data

Sep. 7, 2012 (EP) ..... 12183522

(51) Int. Cl.
*F01D 9/04* (2006.01)
*F01D 9/02* (2006.01)
(Continued)

(52) U.S. Cl.
CPC ..... *F01D 9/023* (2013.01); *F01D 1/04* (2013.01); *F01D 5/08* (2013.01); *F01D 5/14* (2013.01);
(Continued)

(58) Field of Classification Search
CPC ..... F01D 9/041; F01D 9/042; F01D 5/288
See application file for complete search history.

(56) References Cited

U.S. PATENT DOCUMENTS 5,740,674 A 4/1998 Beutin
5,743,708 A 4/1998 Cunha et al.
(Continued)

FOREIGN PATENT DOCUMENTS

CN 101328814 A 12/2008
CN 101915165 A 12/2010
(Continued)

OTHER PUBLICATIONS

RU Decision of Grant dated Dec. 19, 2016, for RU patent application No. 2015107543.

*Primary Examiner* — Justin Seabe
(74) *Attorney, Agent, or Firm* — Beusse Wolter Sanks & Maire

(57) ABSTRACT

A guide vane arrangement of a gas turbine and a method of manufacturing a guide vane arrangement of a gas turbine are provided herein. The guide vane arrangement includes a first guide vane device including a first radially inner platform and a first number of first airfoils, and a second guide vane device including a second radially inner platform and a second number of second airfoils. The first guide vane device and the second guide vane device are arranged along a circumferential direction of the turbine, wherein the first number of the first airfoils differs to the second number of the second airfoils. The first guide vane device is designed with a higher heat resistance than the second guide vane device.

7 Claims, 2 Drawing Sheets

(51) Int. Cl.

| | |
|---|---|
| ***F01D 5/08*** | (2006.01) |
| ***F01D 5/14*** | (2006.01) |
| ***F01D 5/18*** | (2006.01) |
| ***F01D 5/28*** | (2006.01) |
| ***F01D 1/04*** | (2006.01) |

(52) U.S. Cl.

CPC ..... *F01D 5/18* (2013.01); *F01D 5/288* (2013.01); *F01D 9/04* (2013.01); *F01D 9/041* (2013.01); *Y10T 29/49321* (2015.01)

(56) References Cited

U.S. PATENT DOCUMENTS

| | | | | |
|---|---|---|---|---|
| 6,572,330 | B2 * | 6/2003 | Burdgick | F01D 9/02 29/889.22 |
| 7,377,743 | B2 * | 5/2008 | Flodman | F01D 5/186 415/115 |
| 7,836,703 | B2 | 11/2010 | Orlando | |
| 8,677,763 | B2 | 3/2014 | Hatman | |
| 2007/0128020 | A1 | 6/2007 | Dervaux | |
| 2008/0131260 | A1 | 6/2008 | Lee et al. | |
| 2010/0196147 | A1 | 8/2010 | Schilling | |
| 2011/0171018 | A1 | 7/2011 | Garcia-Crespo | |
| 2011/0217159 | A1 | 9/2011 | McMahan et al. | |
| 2012/0082556 | A1 | 4/2012 | Bamett et al. | |

FOREIGN PATENT DOCUMENTS

| | | | |
|---|---|---|---|
| CN | 102200034 | A | 9/2011 |
| EP | 1245788 | A2 | 2/2002 |
| EP | 1213444 | A2 | 6/2002 |
| EP | 1245788 | A2 | 10/2002 |
| EP | 2014872 | A2 | 1/2009 |
| EP | 2161410 | A1 | 3/2010 |
| EP | 2228516 | A2 | 9/2010 |
| EP | 2365198 | A2 | 9/2011 |
| GB | 2114234 | A | 8/1983 |
| JP | S59150903 | A | 8/1984 |
| SU | 1103000 | A1 | 7/1984 |
| WO | 2006108454 | A1 | 10/2006 |
| WO | 2008025583 | A1 | 3/2008 |
| WO | 2011026503 | A1 | 3/2011 |

* cited by examiner

TURBINE VANE ARRANGEMENT

CROSS REFERENCE TO RELATED APPLICATIONS

This application is the US National Stage of International Application No. PCT/EP2013/067440 filed Aug. 22, 2013, and claims the benefit thereof. The International Application claims the benefit of European Application No. EP12183522 filed Sep. 7, 2012. All of the applications are incorporated by reference herein in their entirety.

FIELD OF INVENTION

The present invention relates to a guide vane arrangement for a gas turbine and to a method of manufacturing a guide vane arrangement of a gas turbine.

ART BACKGROUND

In conventional gas turbines a combustor is made from a number of individual burners which feed hot gas into a first stage with nozzle guide vanes that are located downstream of the combustor. The guide vanes direct the hot gases from the individual burners and the air from the compressor stage in a predetermined direction.

In a conventional combustor stage of the turbine, a number of individual burner cans are located circumferentially around the centre of the turbine. Thus, there is some circumferential gas temperature variation associated with the flow of the hot gases from the individual combustor cans in the downstream direction. The periodic circumferential gas temperature variation occurs because between the burner cans a lower temperature at the respective guide vanes is generated and in the vicinity of the circumferential location of the burner a higher temperature at the respective guide vanes is generated.

This circumferential temperature variation leads to a varying temperature profile at each downstream guide vane sector, wherein the temperature profile on each guide vane is dependent on the position of the guide vane relative to the individual burner can, i.e. relative to the installation location of the guide vane inside the turbine.

The vane temperature is a critical aspect to the lifetime of a respective guide vane. Hence, the guide vanes are designed with a predefined heat resistance. The temperature resistance may be increased by the use of cooling air. However, a use of an excessive amount of cooling air reduces the power generated by and efficiency of the gas turbine. In conventional cooling systems, the amount of cooling air has to be designed to match the gas temperature profile for the nozzle guide vane that is exposed to the hottest gas temperature, so that all guide vanes have the same acceptable lifetime. Summarizing, in conventional stator vane stages, in general a standard design of turbine vane arrangements is used, wherein the design of the vanes with respect to its heat resistance is a compromise to suit all circumferential temperature variations of the turbine.

GB 2 114 234 A discloses a combustion turbine with a single airfoil stator vane structure. A stator structure is provided including inner and outer shrouds with a hollow airfoil-shaped vane there between and with areas in the vicinity of the intersections of the shrouds with the airfoil vane walls being of reduced thickness relative to the remainder of the shrouds to provide improved properties of the material in these areas to better respond to thermal stresses imposed on the structure.

US 2007/0128020 A1 discloses a bladed stator for a Turbo-Engine. The bladed stator includes an inner platform and an outer platform and at least one blade fixed between said platforms. At least one of said platforms includes at least one flange having a first end fixed to the platform and a second, free end. The flange includes at least one non-opening free flexibility-increasing cut-out.

SUMMARY OF THE INVENTION

It may be an objective of the present invention to provide guide vanes with an acceptable lifetime and reduce manufacturing costs.

This objective may be solved by a guide vane arrangement for a gas turbine and by a method of manufacturing a guide vane arrangement of a turbine according to the independent claims.

According to a first aspect of the present invention, a guide vane arrangement for a gas turbine is presented. The guide vane arrangement includes a first guide vane device including a first number of first airfoils and a second guide vane device including a second number of second airfoils. The first guide vane device and the second guide vane device are arranged (e.g. detachably coupled together) along a circumferential direction of the turbine. The first number of first airfoils differs to the second number of second airfoils. The first guide vane device is designed with a higher heat resistance than the second guide vane device.

According to a further aspect of the present invention, a method of manufacturing a guide vane arrangement of a turbine is presented. A first guide vane device including a first number of first airfoils is arranged to a second guide vane device including a second number of second airfoils along a circumferential direction of the turbine. The first number of first airfoils differs to the second number of second airfoils. The first guide vane device is designed with a higher heat resistance than the second guide vane device.

A guide vane device includes a platform to which a respective number of airfoils are mounted. Each guide vane device may include an inner shroud with an inner platform and/or an outer shroud with an outer platform, wherein between the inner platform and the outer platform the respective number of airfoils is installed along the circumferential direction. Specifically, each guide vane device includes one inner platform and/or one outer platform to which one or a plurality of airfoils is attached. The respective inner platform (and also the inner shroud) and outer platform (and also the outer shroud) of a respective guide vane device are formed monolithically and integrally. Hence, the first guide vane device and the second guide vane device are structurally divided by the respective shrouds and platforms. In other words, the first guide vane device and the second guide vane device are structurally separated parts of a guide vane stage.

In other words, according to the exemplary embodiment of the present invention, the first guide vane device includes a first platform and a first number of airfoils, wherein to the first platform the first number of airfoils is attached, wherein the first airfoils are attached one after another along the circumferential direction. Accordingly, the second guide vane device includes a second platform and a second number of airfoils, wherein to the second platform the second number of airfoils is attached, wherein the second airfoils are attached one after another along the circumferential direction.

The first guide vane device and the second guide vane device are arranged along the circumferential direction of the turbine. In particular, the first platform and the second are located adjacent to each other when the first guide vane device and the second guide vane device are arranged one after another along the circumferential direction. The first number of first airfoils attached to the first platform differs to the second number of second airfoils attached to the second platform.

The turbine includes a turbine shaft which rotates around a rotary axis of the turbine. A direction around the rotary axis is denoted as the circumferential direction. A direction which runs through the rotary axis and which is perpendicular to the rotary axis is denoted as the radial direction.

Hence, the (radially) inner platform of a respective guide vane device is located closer to the rotary axis along a radial direction with respect to the (radially) outer platform of a respective guide vane device.

The airfoils (guide vanes) include an aerodynamical profile. Hot working gas of the turbine streams against a leading edge of the airfoil and exits the airfoil at a trailing edge of the airfoil. The hot working gas may be for example a combustion gas which exits the combustors, and in particular the combustor cans of the gas turbine, which is arranged one after another along the circumferential direction. The airfoils of the guide vane device direct the working gas in a desired streaming direction.

The first guide vane device and the second guide vane device are arranged one after another along the circumferential direction. In an exemplary embodiment, the first guide vane device is detachably coupled to the second guide vane device. In a further exemplary embodiment, the respective platform of the first guide vane device abuts against a respective plat-form of the second guide vane device along the circumferential direction.

The first guide vane device and the second guide vane device may be mounted detachably to a radially inner vane carrier or a radially outer vane carrier. In particular, the first guide vane device and the second guide vane device may be fixed by a screw connection to the respective vane carriers. Hence, the term "detachably coupling" may denote a direct or indirect coupling of the respective guide vane devices with respect to each other. For example, along the circumferential direction, the first guide vane device and the second guide vane device may be detachably fixed to the respective vane carrier such that the first guide vane device and the second guide vane device may be arranged to the vane carrier very flexible and exchangeable.

Hence, at hot regions along the circumferential direction of a turbine at a guide vane stage of a turbine, the first guide vane device is installed, because the first guide vane device includes a higher heat resistance in comparison to the second guide vane device. Hence, it is not longer necessary to provide along the complete circumferential direction guide vane devices with the highest heat resistance. In the colder temperature regions along the circumferential direction of a turbine vane stage the second guide vane devices may be installed which include a lower heat resistance in comparison to the first guide vane device.

Because the second guide vane device includes a lower heat resistance in comparison to the first guide vane device, the second guide vane device needs a lower heat protection which results in a cheaper design and a cheaper manufacturing process in comparison to the first guide vane devices. Moreover, also the cooling fluid consumption of the second guide vane device is lower than the first guide vane device, such that by providing a certain number of second guide vane devices, the overall cooling fluid consumption may be reduced.

Moreover, by having a different amount of first airfoils in comparison to the second airfoils, the guide vane arrangement may be more exactly adopted to a certain heat distribution of a guide vane stage of a gas turbine.

The heat resistance of the respective guide vanes may be controlled by a variety of provisions which are described in more detail in the following. In particular, the heat resistance of a respective guide vane device may be controlled for example by the use of a certain material, such as ceramic material, composite material or metal material. Furthermore, the respective heat resistance of a respective guide vane may be adjusted by applying a temperature resistance coating and/or a thermal barrier coating, for example. Furthermore, the heat resistance of a respective guide vane device may be controlled by applying a cooling duct system for cooling the respective guide vane device with a cooling fluid.

According to a further exemplary embodiment of the present invention, the first number of the first airfoils is smaller than the second number of the second airfoils. Specifically, according to a further exemplary embodiment, the first number of the first airfoils is one and the second number of the second airfoils is two or higher.

Hence, the first guide vane device, which has a higher heat resistance than the second guide vane device, may be designed smaller and in smaller units. A smaller part and hence a smaller guide vane device, respectively, is more robust against stress under the influence of the high temperatures. Furthermore, due to the smaller size of the first guide vane device, the first guide vane device is easier to install at the hot temperature regions.

The first guide vane device and the second guide vane device may also be denoted as a vane nozzle, wherein in an exemplary embodiment, the first guide vane device is a single vane nozzle having one airfoil and the second guide vane device is a two-vane nozzle having two airfoils.

According to a further exemplary embodiment, the first guide vane device is coated with a first temperature resistant coating. In a further exemplary embodiment, only the first guide vane device is coated with a temperature resistant coating. Hence, the second guide vane device may be free of any temperature resistant coatings. Hence, in the hot regions of the turbine at a turbine vane stage, the more expensive first guide vane devices including first temperature resistant coatings may be applied, wherein in the cooler locations the less expensive second guide vane devices may be installed which include no temperature resistant coatings or only a thin or more inexpensive temperature resistant coating of the second guide vane device.

In a further exemplary embodiment, the second guide vane de-vice is coated with the second temperature resistant coating. In particular, the first heat resistant coating is a coating which is more heat-resistant than the second heat resistant coating. This may be adjusted by choosing different compositions and materials for the respective heat resistant coating or by the thickness of the respective first heat resistant coating with respect to the second heat resistant coating.

Hence, a first temperature resistant coating is larger than a second thickness of the second temperature resistant coating. The respective first thickness may be measured at the thickest location of the first temperature resistant coating at the first guide vane device and the second thickness of the second temperature resistant coating may be measured at the thickest location of the second temperature resistant coating.

Hence, by the above-described temperature resistant coatings the respective heat resistances of the respective first and second guide vane devices may be adjusted.

The temperature resistance coating may be a MCrAlY coating composition, wherein it is indicated by the "M" in particular Nickel (Ni), Cobalt (Co) or a mixture of both. The MCrAlY coating may be coated onto a surface of the respective guide vane devices by application methods such as electro-plating, thermal spray techniques or Electron Beam Physical Vapour Deposition (EBPVD). Furthermore, the temperature resistance coating may further include a PtAl-coating, an aluminide anti-corrosive and oxidative coating, such as a pack cementation or Vapour Phase Aluminide (VPA) coating, and other thermal barrier layers.

According to a further exemplary embodiment of the present invention, the first guide vane device includes a first cooling duct through which a cooling fluid is flowable. In an exemplary embodiment, only the first cooling duct may include a cooling duct and the second guide vane device is free of any cooling ducts. In particular, the first cooling duct is arranged inside the first airfoils of the first guide vane device and/or runs along the respective inner and/or outer platform of the first guide vane device. The cooling fluid may be a cooling gas, such as air, or a cooling liquid, such as water or oil, for example.

A respective guide vane device which includes a complex run of a respective cooling duct is more complex to manufacture than a respective guide vane device which is free of any cooling ducts or which includes a simpler design of cooling ducts in comparison to the first cooling duct. Hence, at hot regions of a guide vane stage, the more expensive first guide vane devices including the first cooling ducts may be in-stalled and at cooler regions of the guide vane stage, the less expensive second guide vane devices which may be free of any cooling duct may be installed.

Alternatively, also the second guide vane device includes a second cooling duct through which a further cooling fluid is flowable. In particular, the second cooling duct is arranged inside the second airfoils of the second guide vane device and/or runs along the respective inner and/or outer platform of the second guide vane device.

The further cooling fluid may be the same cooling fluid as the cooling fluid flowing through the first cooling duct. Alternatively, the further cooling fluid differs to the cooling fluid flowing through the first cooling duct. Hence, separate cooling fluid sources may be used and coupled to the first cooling duct and the second cooling duct, respectively.

According to a further exemplary embodiment, the first cooling duct includes a larger flow diameter (also called hydraulic diameter) than the second cooling duct. The respective flow diameter of the first cooling duct may be measured at the tightest and narrowest section of the first cooling duct. Accordingly, the flow diameter of the second cooling duct may be measured at the tightest and narrowest section of the second cooling duct.

According to a further exemplary embodiment, the first cooling duct includes a first aperture for injecting or draining the cooling fluid in or out of the first cooling duct and the second cooling duct includes a second aperture for injecting or draining the cooling fluid in or out of the first cooling duct. The first aperture is larger than the second aperture such that a higher mass flow of cooling fluid is flowable in or out of the first cooling duct than in or out of the second cooling duct. The first aperture and the further aperture may be coupled to a cooling fluid system of the turbine. Hence, a higher heat resistance for the first guide vane device in comparison to the second guide vane device may be provided.

Hence, a higher mass flow rate of the first cooling fluid is flowable through the first cooling duct in comparison to the mass flow of the further cooling fluid through the second cooling duct. Hence, the cooling fluid consumption of cooling fluid flowing through the first cooling duct is higher than the cooling fluid consumption of the cooling fluid flowing through the second cooling duct. Additionally, the cooling effectivity of the cooling fluid flowing through the first cooling duct is higher than the cooling effectivity of the further cooling fluid flowing through the second cooling duct. Hence, the overall cooling fluid consumption may be adjusted and reduced because at the hottest regions of the guide vane stage, where the first guide vane device is installed, a higher cooling fluid consumption and a higher cooling power is provided and at the cooler regions of the guide vane stage, where the second guide vane device is in-stalled, the lesser cooling fluid consumption and a lower cooling effectivity is provided.

According to a further exemplary embodiment, along the circumferential direction a plurality of further first guide vane devices and/or a plurality of further second guide vane devices are installed at a guide vane stage along a circumferential direction.

Specifically, according to a further exemplary embodiment of the method, data of a heat distribution of the hot working gas of the turbine along the circumferential direction during operation of the turbine is provided. On the basis of the provided data of the heat distribution, first temperature areas and second temperature areas in the heat distribution are provided, wherein the first temperature areas are hotter than the second temperature areas during operation of the turbine. On the basis of the determined first and second temperature areas, the first guide vane device and the second guide vane device are arranged, such that the first guide vane device is located in the first temperature area and the second guide vane device is located in the second temperature area. Hence, the arrangements of the respective first and second guide vane devices along a circumferential direction of a turbine vane stage may be exactly adapted to comply with a certain heat distribution of a special type of turbine at a respective turbine vane stage. Hence, the arrangement of first and second guide vane devices is optimized with respect to the lifetime of the respective guide vane device and the manufacturing costs of the guide vane arrangement, because only at the hottest regions in the heat distribution of the turbine the more expensive and more complex first guide vane devices are installed, wherein at the cooler regions the cheaper and more incomplex second guide vane devices are installed.

Summarizing, by the present invention, the problems of excessive cooling air usage and manufacturing cost of a guide vane stage are solved and reduced by the use of an assembly of guide vane devices including first guide vane devices with e.g. one airfoil with an increased cooling and a higher heat resistance for the use in the higher temperature areas and second guide vane devices including e.g. two airfoils (double vane nozzles) with reduced cooling and reduced overall cost for use in the lower temperature areas. This solution gives an effective reduction of cooling air consumption and a reduction in overall costs of the turbine vane assembly.

It has to be noted that embodiments of the invention have been described with reference to different subject matters. In particular, some embodiments have been described with reference to apparatus type claims whereas other embodiments have been described with reference to method type claims. However, a person skilled in the art will gather from the above and the following description that, unless other notified, in addition to any combination of features belonging to one type of subject matter also any combination between features relating to different subject matters, in particular between features of the apparatus type claims and features of the method type claims is considered as to be disclosed with this application.

BRIEF DESCRIPTION OF THE DRAWINGS

The aspects defined above and further aspects of the present invention are apparent from the examples of embodiment to be described hereinafter and are explained with reference to the examples of embodiment. Aspects of the invention will be described in more detail hereinafter with reference to examples of embodiment but to which the invention is not limited.

DETAILED DESCRIPTION

Figure 1:
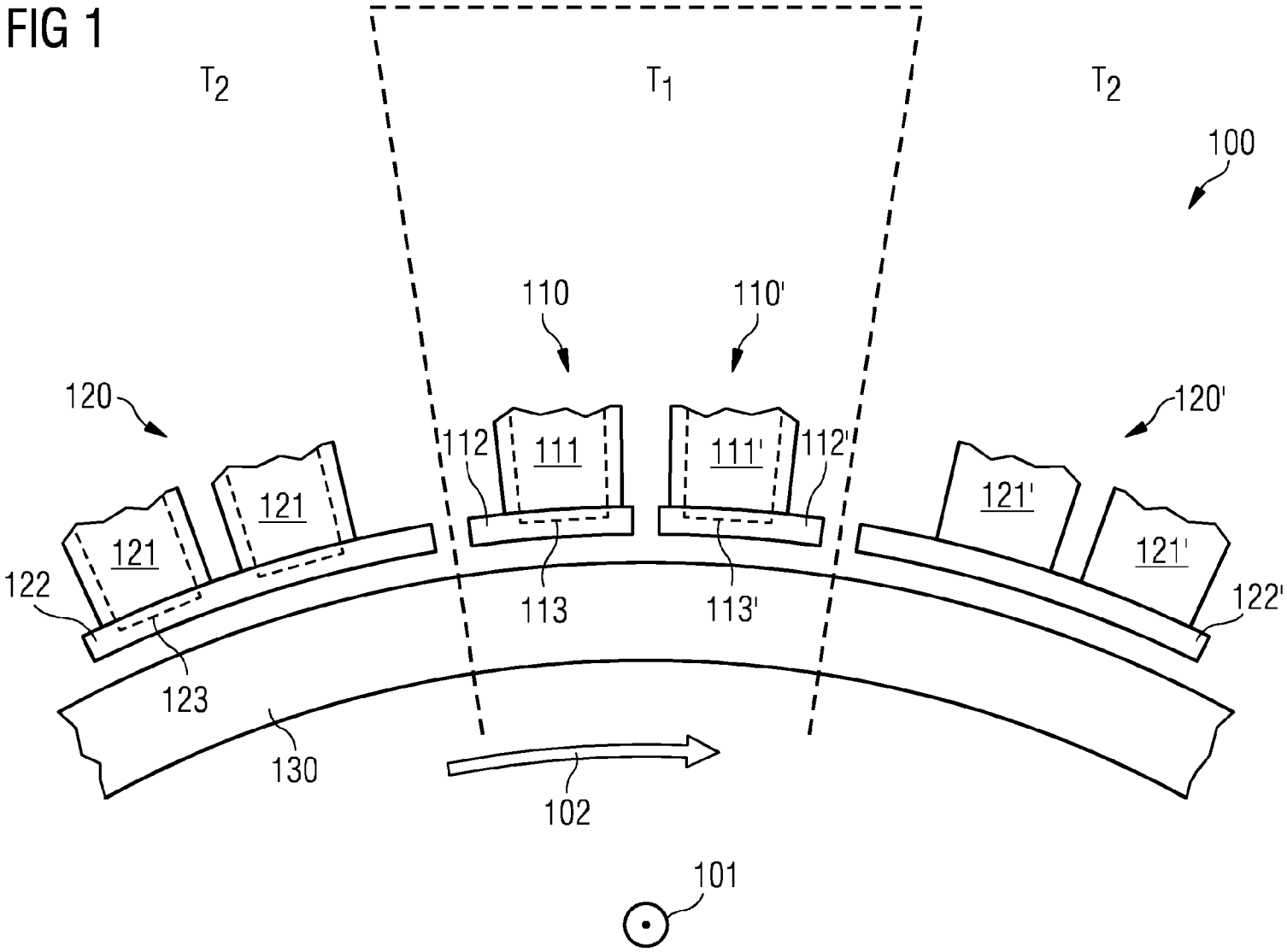
FIG. 1 shows a schematical view of a guide vane arrangement according to an exemplary embodiment of the present invention.

The illustrations in the drawings are schematic. It is noted that in different figures similar or identical elements are provided with the same reference signs.

FIG. 1 shows a guide vane arrangement 100 for a gas turbine. A guide vane arrangement 100 includes a first guide vane device 110 including a first number of first airfoils 111 and a second guide vane device 120 including a second number of second airfoils 121. The first guide vane device 110 and the second guide vane device 120 are arranged one after another, e.g. detachably coupled together, along a circumferential direction 102 of the turbine. The first number of the first airfoils 111 differs to the second number of the second airfoils 121. The first guide vane device 110 is designed with a higher heat resistance than the second guide vane device 120.

In the exemplary embodiment shown in FIG. 1, the first guide vane device 110 includes one airfoil 111 (guide vane) and is a so-called single vane nozzle. The second guide vane device 120 includes in the exemplary embodiment shown in FIG. 1 two second airfoils 121 (guide vanes) and is a so-called double vane nozzle.

As shown in FIG. 1, the turbine includes a rotary axis 101. A direction around the rotary axis 101 is denoted as the circumferential direction 102. Along the circumferential direction 102, different temperature areas T1, T2 exists during operation of the turbine. The first temperature area T1 is for example hotter than the second temperature area T2. The different temperature areas T1, T2 form a heat distribution along the circumferential direction 102. This varying heat distribution is caused by the arrangement of several combustion chambers, i.e. combustion cans, along the circumferential direction 102 of the turbine.

As can be taken from FIG. 1, in the hotter first temperature area T1 the first guide vane device 110 and, depending on the circumferential size of the first temperature area T1, a plurality of further first guide vane devices 110' are arranged. In the second temperature areas T2, second guide vane devices 120 and further second guide vane devices 120' are arranged.

The first guide vane device 110 includes a first shroud with a first platform 112. The first platform 112 shown in FIG. 1 is a radially inner platform. In FIG. 1, a radially inner vane carrier 130 is shown. The first guide vane device 110 is mounted by its first inner platform 112 e.g. detachably to the inner vane carrier 130. The airfoil 111 is mounted to a radially outer surface of the first radially inner platform 112 of the first guide vane device 110 and extends along a radially outer direction.

The first guide vane device 111 may further include a first cooling duct 113 which runs along the first platform 112 and through the airfoil 111.

Accordingly, the second guide vane device 120 includes a second inner shroud with a second inner platform 122. In contrast to the first inner platform 112 of the first guide vane device 110, two or more second airfoils 121 are mounted to one common second inner platform 122. The second guide vane device 120 may include a second cooling duct 123 which may run along the respective second airfoils 121 and along the second inner platform 122.

The first guide vane devices 110, 110' have a higher heat resistance than the second guide vane devices 120, 120'. The higher heat resistance of the first guide vane devices 110, 110' may be adjusted by using more cooling fluid or by using respective material compositions or temperature resistant coatings.

The arrangement and the pattern of the first guide vane de-vices 110, 110' and the second guide vane devices 120, 120' along the circumferential direction 102 may be determined on the basis of the circumferential location of the hotter first temperature areas T1 and the colder second temperature areas T2. The heat distribution of the first temperature areas T1 and the second temperature areas T2 along the circumferential direction 102 may be determined on the basis of data of a heat distribution of a respective turbine during operation. The data may be achieved by simulations, by a computer model and/or by experimental tests.

Figure 2:
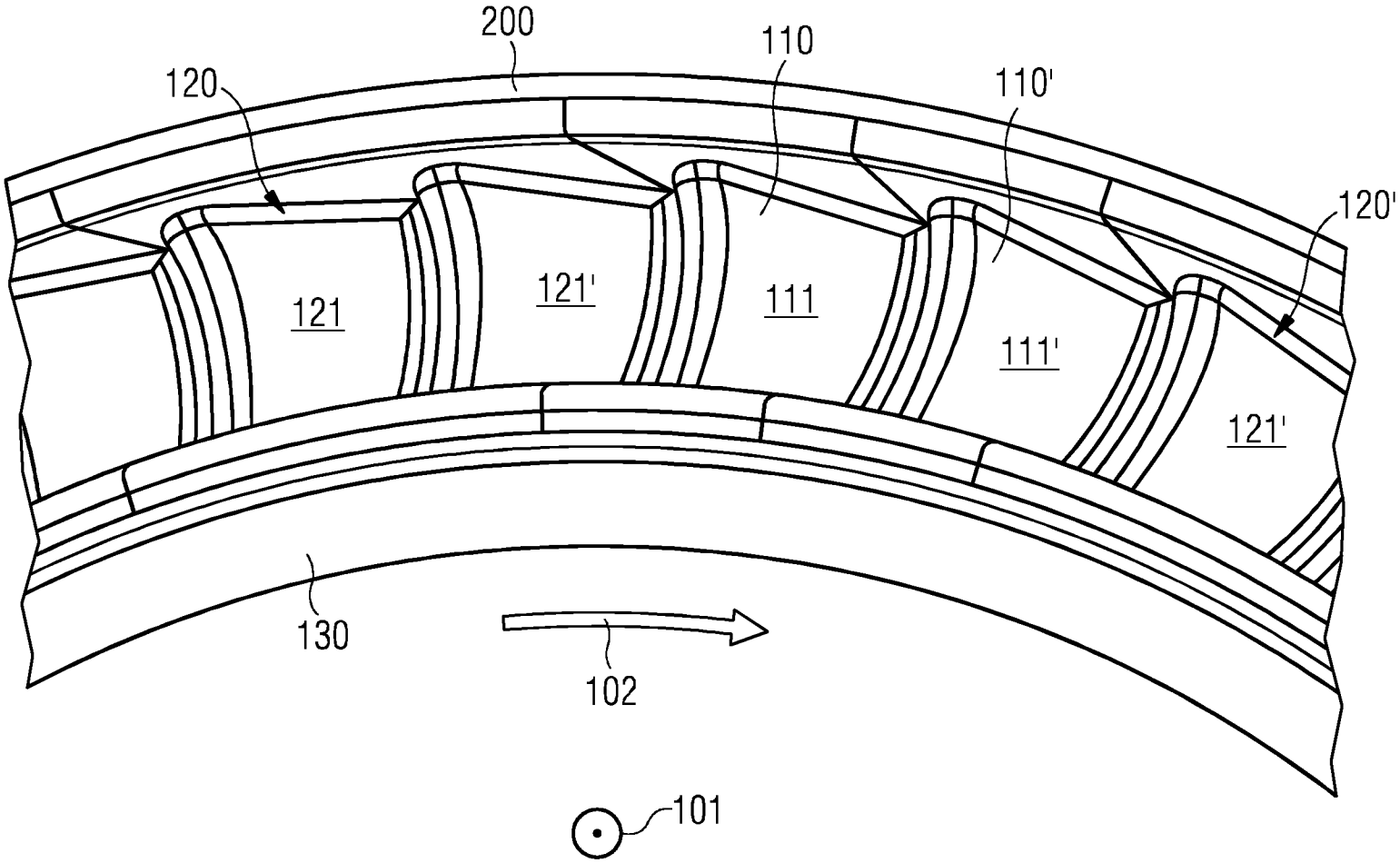
FIG. 2 shows a perspective view of the exemplary embodiment of a guide vane arrangement as shown in FIG. 1 according to an exemplary embodiment of the present invention.

FIG. 2 shows an exemplary embodiment of the present invention as shown in FIG. 1. Additionally, in FIG. 2, a radially outer vane carrier 200 is shown. As can be taken from FIG. 2, the first guide vane devices 110, 110' and the second guide vane devices 120, 120' are mounted and coupled detachably by its respective platforms 112, 122 to the inner vane carrier 130 and the outer vane carrier 200. Hence, along the circumferential direction 102, a variety of first and second guide vane devices 110, 110', 120, 120' are arranged dependent on the heat distribution of a guide vane stage of a turbine.

In FIG. 1 and in FIG. 2 circumferential sections of a guide vane stage of a turbine are shown. However, the guide vane stage forms generally a circumferentially closed, ring-shaped stage. The respective vane carriers 130, 200 may have a semi circle profile or a full circle profile.

It is particularly advantageous to have the first guide vane device 110 with one single airfoil 111 (guide vane), i.e. it is implemented as a single vane nozzle. That allows an easy application of a coating from all sides, particularly by spraying, which may not be so easy for a double vane nozzle or a nozzle with even more vanes. Furthermore a single vane nozzle may be shorter in circumferential length compared to a double vane nozzle or a nozzle with even more vanes. This has the consequence that it results in less stress compared to a nozzle with a longer circumferential length.

According to the previously said, the orientation and size of the vanes may be identical to all nozzles, independently whether provided via a single nozzle or a nozzle with a plurality of vanes. Alternatively, as the single nozzle may be provided in sections with higher temperature and possibly also with different fluid flow speed and fluid flow orientation, it is also possible to provide a different orientation of the vane of the single nozzle than the vanes of the other nozzles. Also the distance between two vanes can be adjusted by using single nozzles in comparison to nozzle with a plurality of vanes.

It should be noted that the term "comprising" does not exclude other elements or steps and "a" or "an" does not exclude a plurality. Also elements described in association with different embodiments may be combined. It should also be noted that reference signs in the claims should not be construed as limiting the scope of the claims.

The invention claimed is:

1. A guide vane arrangement for a gas turbine, the guide vane arrangement comprising:

a first guide vane device comprising a first platform and a first number of first airfoils, wherein the first number of first airfoils is attached to the first platform, and a second guide vane device comprising a second platform and a second number of second airfoils, wherein the second number of second airfoils is attached to the second platform, wherein the first guide vane device and the second guide vane device are arranged along a circumferential direction of the turbine, wherein the first number of the first airfoils differs to the second number of the second airfoils, and wherein the first guide vane device is designed with a higher heat resistance than the second guide vane device, wherein the first guide vane device is coated with a first temperature resistant coating, wherein the second guide vane device is coated with a second temperature resistant coating, and wherein a first thickness of the first temperature resistant coating is larger than a second thickness of the second temperature resistant coating; and further comprising:

a further first guide vane device comprising a further first number of further first airfoils, and wherein the further first guide vane device is arranged between the first guide vane device and the second guide vane device along the circumferential direction of the turbine, wherein the further first number of further first airfoils differs from the second number of second airfoils, and wherein the further first guide vane device is designed with a higher heat resistance than the second guide vane device.

2. The guide vane arrangement according to claim 1, wherein the first number of the first airfoils is smaller than the second number of the second airfoils.

3. The guide vane arrangement according to claim 2, wherein the first number of the first airfoils is one and the second number of the second airfoils is two or higher.

4. The guide vane arrangement according to claim 1, wherein the first guide vane device comprises a first cooling duct through which a cooling fluid is flowable.

5. The guide vane arrangement according to claim 4, wherein the second guide vane device comprises a second cooling duct through which a further cooling fluid is flowable.

6. The guide vane arrangement according to claim 5, wherein the first cooling duct comprises a larger hydraulic diameter than the second cooling duct.

7. The guide vane arrangement according to claim 4, wherein the first cooling duct comprises a first aperture for injecting or draining the cooling fluid in or out of the first cooling duct, and wherein the second cooling duct comprises a second aperture for injecting or draining the cooling fluid in or out of the second cooling duct, wherein the first aperture is larger than the second aperture such that a higher mass flow of cooling fluid is flowable in or out of the first cooling duct than in or out of the second cooling duct.

* * * * *